United States Patent [19]

Pelavin

[11] 4,098,376

[45] Jul. 4, 1978

[54] GARMENT BAG

[75] Inventor: Joseph Y. Pelavin, North Bergen, N.J.

[73] Assignee: Lark Luggage Corporation, New York, N.Y.

[21] Appl. No.: 798,511

[22] Filed: May 19, 1977

[51] Int. Cl.[2] ..... A45C 3/00

[52] U.S. Cl. ..... 190/43; 190/41 Z

[58] Field of Search ..... 190/41 Z, 43, 41 B, 190/41 R, 41 C; 206/282, 286, 287; 312/3, 4, 5, 6

[56] References Cited

U.S. PATENT DOCUMENTS

| | | | |
|---|---|---|---|
| 2,087,210 | 7/1937 | Marbury | 190/41 Z X |
| 3,244,261 | 4/1966 | Herz | 190/43 |
| 3,746,151 | 7/1973 | Brophy | 206/287 |
| 3,933,229 | 1/1976 | Pelavin | 190/41 Z X |
| 3,958,675 | 5/1976 | Rosenblum | 190/41 Z X |

FOREIGN PATENT DOCUMENTS

| | | | |
|---|---|---|---|
| 1,161,414 | 3/1958 | France | 312/3 |

*Primary Examiner*—Donald F. Norton

*Attorney, Agent, or Firm*—Blum, Moscovitz, Friedman & Kaplan

[57] ABSTRACT

A foldable garment bag is provided wherein the forward wall of the bag has a longitudinal zippered opening defining a pair of front panels that permit access to the interior of the bag. At least the outer, upper portion of each front panel is releasably secured by means of a pair of zippers, to permit the user to open the front panels transversely as well as longitudinally.

5 Claims, 3 Drawing Figures

GARMENT BAG

BACKGROUND OF THE INVENTION

This invention relates generally to a garment bag of the type generally used to transport garments stored on hangers and in which the bag may be folded over along a transverse medial line. In the art, such bags have generally had a forward wall having a longitudinal zippered opening through which the garments are inserted into the interior of the bag. However, in many instances insertion of large or bulky garments through the narrow opening provided by the zipper was quite difficult. It was frequently necessary for the user to pull on the front panels in order to maintain a sufficient opening between them, which can lead to a tearing of the material used to construct the garment bag. Alternatively, if the front panels are not pulled apart, the garment may be creased or torn by the zipper teeth as it is inserted. The instant invention, provides a novel garment bag construction in order to overcome these difficulties.

SUMMARY OF THE INVENTION

Generally speaking, in accordance with the invention, a foldable garment bag especially suitable for transporting garments stored on hangers is provided. The forward wall of the bag has a longitudinal zippered opening defining a pair of front panels that permit access to the interior of the bag. At least the outer, upper periphery of the front panels are releasably secured in place to said bag by means of a pair of zippers, to permit the user to open the front panels transversely as well as longitudinally so that large or bulky items may be more easily placed in the interior of the bag. Said pair of zippers may extend around the respective upper, outer corners of said front panel.

Accordingly, it is an object of this invention to provide an improved foldable garment bag having front panels capable of being opened widely for access to the interior thereof.

Another object of this invention is to provide an improved foldable garment bag constructed and arranged to allow large or bulky garments to be stored therein.

A further object of this invention is to provide an improved foldable garment bag that significantly decreases the chances of the garments stored therein being damaged or creased while being inserted.

Still another object of the invention is to provide an improved foldable garment bag whose front panels need not be held open as garments are placed within.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
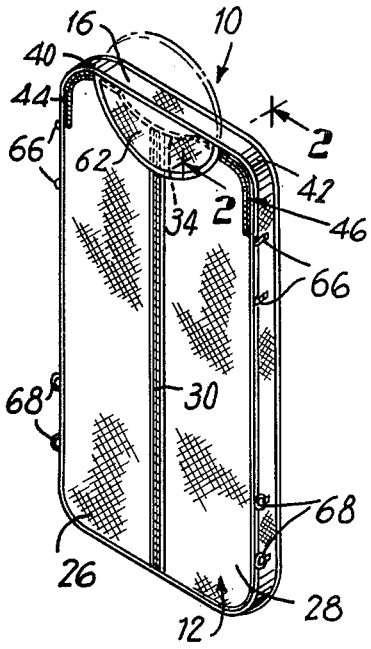
FIG. 1 is a perspective view of a foldable garment bag constructed in accordance with the preferred embodiment of the instant invention, with the upper flap shown in its raised position in phantom.
Figure 2:
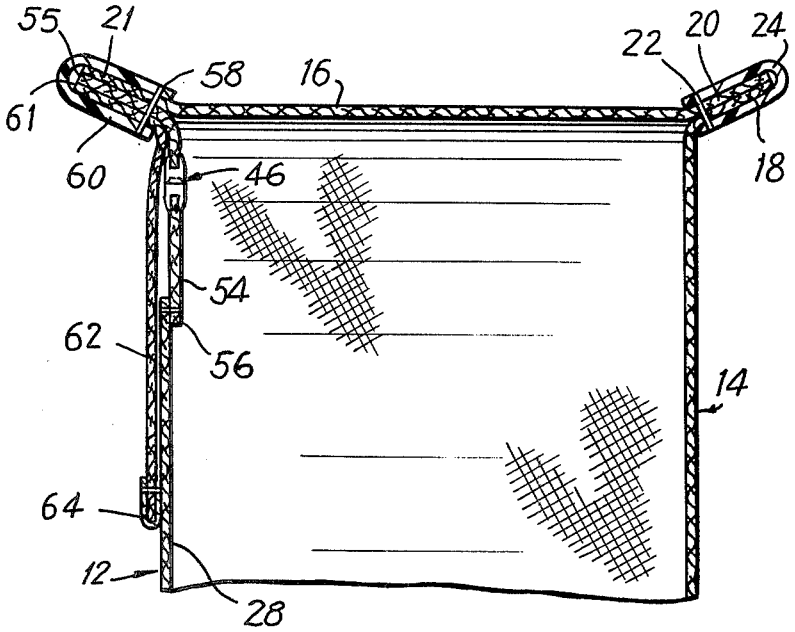
FIG. 2 is a fragmentary sectional view taken along line 2—2 of FIG. 1.
Figure 3:
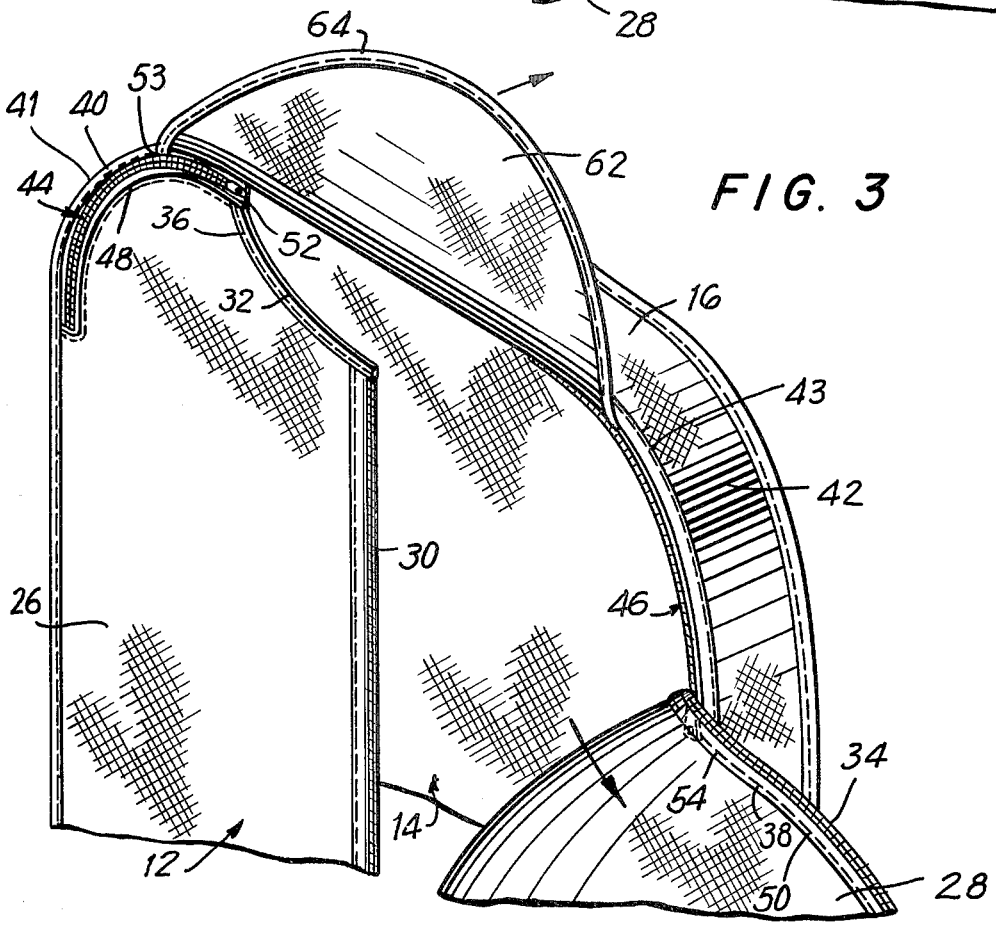
FIG. 3 is a partial perspective view of the upper portion of a garment bag constructed in accordance with the instant invention with the upper flap in its raised position and one of the front panels opened.

The drawings illustrate a foldable garment bag generally indicated at 10 which is especially suitable for carrying garments hung on hangers. Garment bag 10 has a forward wall 12 and a rearward wall 14 joined together by a peripheral side wall 16. The edge 18 of rearward wall 14 is joined to a rearward edge 20 of side wall 16 by means of sewn thread 22 which also serves to secure U-shaped edging 24 which protects edges 18 and 20 from raveling and wear. Forward wall 12 is divided into two front panels 26 and 28 by means of a zipper 30 running longitudinally along forward wall 12.

The upper central edges 32, 34 of front panels 26, 28 are concavely rounded and trimmed with edgings 36, 38 respectively. The upper corners 40, 42 of garment bag 10 are rounded and their edges 41, 43 facing forward wall 12 carry zippers 44, 46 which extend angularly along each corner for approximately 90°. The outer upper edges 48, 50 of forward panels 26, 28 respectively are curved to conform with corners 40, 42 and are secured to the lower cloth portions 52, 54 of zippers 44, 46 by means of thread 56. The upper cloth portions 53, 55 of zippers 44, 46 are secured between a forward edge 21 of side wall 16 and edge 61 of flap 62 for a portion of their length and to only forward edge 21 of side wall 16 for the remainder of their length by means of thread 58 which also secures and edging 60. Flap 62 is generally semi-circular in configuration and serves to cover edges 32, 34 of front panels 26, 28 and a portion of zippers 44, 46 and 30. Flap 62 has edging 64 about its outer periphery.

Thus, the provision of zippers 44, 46 about the upper corners of front panels 26, 28 provide for easier access to the interior of garment bag 10. The transverse opening of front panels 26, 28 permitted by zippers 44, 46 permits garments to pass through a wider opening than that provided by zipper 30 alone.

After the garment to be stored within garment bag 10 has been placed therein and zippers 30, 44 and 46 have been secured and flap 62 lowered, garment bag 10 may be folded along a line transverse to that of zipper 30 at its midpoint and may be secured by hook means 66 engaging ring means 68, mounted to side wall 16.

It will thus be seen that the objects set forth above, and those made apparent from the preceding description, are efficiently attained and, since certain changes may be made in the above construction without departing from the spirit and scope of the invention it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a foldable garment bag of the type wherein a forward wall includes a longitudinal opening defining first and second front panels and first releasable closure means are provided for sealing the longitudinal opening, the improvement comprising second releasable closure means located proximate to at least the outer, upper periphery of said first front panel for releasably securing the upper periphery of said first front panel to permit transverse as well as longitudinal opening of said panel, third closure means located proximate to at least the outer, upper periphery of said second front panel for releasably securing the upper periphery of said second front panel to permit transverse as well as longitudinal opening of said second front panel and each of said first and second front panels are formed with an upper, outer curved corner, said second and third closure means each extending along the associated upper, outer curved corner of the associated front panel into the respective side peripheries of the front panels.

2. A garment bag as claimed in claim 1, further including a flap covering at least a portion of said first, second and third closure means.

3. A garment bag as claimed in claim 1, wherein at least one of said first, second and third closure means comprise zippers.

4. In a foldable garment bag of the type wherein a forward wall includes a longitudinal opening defining first and second front panels and first releasable closure means are provided for sealing the longitudinal opening, the improvement comprising second releasable closure means located proximate to at least the outer, upper periphery of said first front panel for releasably securing the upper periphery of said first front panel to permit transverse as well as longitudinal opening of said panel, third closure means located proximate to at least the outer, upper periphery of said second front panel for releasably securing the upper periphery of said second front panel to permit transverse as well as longitudinal openings of said second front panel, the portions of said front panels located intermediate said first closure means and said second and third closure means are cut away.

5. A garment bag as claimed in claim 4, wherein at least one of said first, second and third closure means comprise zippers.

* * * * *